US005911841A

United States Patent [19]

Ohmi

[11] Patent Number: 5,911,841

[45] Date of Patent: Jun. 15, 1999

[54] STEEL HAVING EXCELLENT CORROSION RESISTANCE

[76] Inventor: Tadahiro Ohmi, 1-17-301, Komegabukuro 2-chome, Aoba-ku, Sendai-shi, Miyagi-ken 980, Japan

[21] Appl. No.: 08/781,777

[22] Filed: Jan. 9, 1997

Related U.S. Application Data

[63] Continuation of application No. 08/411,632, Mar. 30, 1995, Pat. No. 5,656,099, which is a continuation of application No. PCT/JP93/01431, Oct. 5, 1993.

[30] Foreign Application Priority Data

Oct. 5, 1992 [JP] Japan ..... 4-266382

[51] Int. Cl.[6] ..... C23C 8/04

[52] U.S. Cl. ..... 148/280; 148/286; 428/472.1

[58] Field of Search ..... 428/472.1; 148/280, 148/286

[56] References Cited

U.S. PATENT DOCUMENTS

| | | | |
|---|---|---|---|
| 4,168,184 | 9/1979 | Hultquist et al. | 148/286 |
| 4,266,987 | 5/1981 | Wang | 148/280 |
| 5,169,515 | 12/1992 | Ngen et al. | 148/280 |
| 5,188,714 | 2/1993 | Davidson et al. | 148/280 |
| 5,226,968 | 7/1993 | Ohmi et al. | 118/720 |
| 5,259,935 | 11/1993 | Davidson et al. | 148/280 |
| 5,456,768 | 10/1995 | Tomari et al. | 148/280 |

FOREIGN PATENT DOCUMENTS

| | | | |
|---|---|---|---|
| 0596121 | 12/1992 | European Pat. Off. . | |
| 0091543 | 7/1975 | Japan | 428/472.1 |
| 50-91543 | 7/1975 | Japan . | |
| 57-47759 | 10/1982 | Japan . | |
| 1-31956 | 2/1989 | Japan . | |
| 4-183846 | 6/1992 | Japan . | |
| 5-33116 | 2/1993 | Japan . | |
| 1407407 | 9/1975 | United Kingdom | 148/286 |
| 2 092 621 | 8/1982 | United Kingdom . | |

*Primary Examiner*—David A. Simmons
*Assistant Examiner*—Robert R. Koehler
*Attorney, Agent, or Firm*—Marshall, O'Toole, Gerstein, Murray & Borun

[57] ABSTRACT

The present invention provides a stainless steel having by far higher corrosion resistance than those of the prior art and a method of forming an oxide passivation film having a chromium oxide layer on the surface thereof

2 Claims, 7 Drawing Sheets

STEEL HAVING EXCELLENT CORROSION RESISTANCE

This is a continuation of U.S application Ser. No. 08/411,632 filed Mar. 30, 1995, now U.S. Pat. No. 5,656,099 issued Aug. 12, 1997, which in turn is the U.S. national phase of International Application PCT/JP93/01431 filed Oct. 5, 1993.

TECHNICAL FIELD

The present invention relates to a method of forming an oxide passivation film having a layer consisting mainly of chromium oxide, (a layer containing no iron oxide, hereinafter be referred to simply as "chromium oxide layer"), on the outermost surface thereof, and relates to a stainless steel having excellent corrosion resistance.

BACKGROUND ART

A known method of forming a passivation film on a stainless steel surface is the wet process which forms the passivation film by immersing an electrolytically polished stainless steel into a solution of chemicals such as nitric acid at about 60° C. The passivation film thus formed, however, contains iron oxide, though it gives a chromium-rich composition. In addition, the passivation film shows non-satisfactory corrosion resistance because of its thin layer, 20Å (angstrom) or less, and because of the presence of many pin holes.

Furthermore, that type of passivation film emits a considerable amount of moisture from its surface. The curve with the symbol of a closed circle in FIG. 9 shows the data of emission of moisture at room temperature from the surface of an oxide passivation film prepared by the wet process, determined by APIMS analysis. As seen in the figure, the oxide passivation film formed by the wet process can not fully release its moisture even after 100 min. of emission. Since the oxide passivation film prepared by the wet process contains a considerable amount of moisture, it is inapplicable to semiconductor production equipment which requests emission-free condition. Therefore, that type of oxide passivation film further needs to be subjected to heat treatment such as baking, which requires extra processing time.

As an alternative method of forming a passivation film emitting an extremely small amount of moisture, present inventor proposed a dry process. The dry process is performed by directly reacting an electrolytically polished stainless steel with oxygen gas, then reducing the obtained iron oxide with hydrogen gas, followed by thermally treating the reduced material in an atmosphere of inert gas such as argon gas to form a passivation film consisting mainly of chromium oxide. FIG. 10 shows the block flow diagram of the dry process.

In FIG. 10, the number (1) denotes the baking step to remove surface moisture from the stainless steel, and (2) denotes the oxidation step which is conducted in an oxygen atmosphere. The film obtained in step (2) is an oxide passivation film consisting mainly of iron oxide. The number (3) denotes the reducing step to reduce the iron oxide and to obtain chromium oxide. The number (4) denotes the annealing step which is conducted in an inert gas atmosphere to convert the product into a passivation film consisting mainly of chromium oxide.

The curve with the symbol of a closed triangle in FIG. 9 shows the data of moisture emission from the surface of the passivation film prepared by the dry process. As seen in the figure, the moisture emission significantly decreased in the case of the dry process compared with the case of the wet process.

However, the above-described dry process to form a passivation film takes time because it conducts oxidation and reduction separately.

In response to this disadvantage, to solve the problems the present inventor provided another alternative method of forming an oxide passivation film consisting mainly of chromium oxide. According to the another alternative method, a stainless steel is subjected to electrolytic polishing or electrochemical buffing in a separate stage, and the pre-treated stainless steel is baked in an inert gas atmosphere to remove moisture from the surface thereof, then it is thermally treated at a temperature range of from 300 to 600° C. in an atmosphere of hydrogen gas or a mixture of hydrogen and an inert gas, which atmosphere further contains about 100 ppb of oxygen or $H_2O$. (Japanese Patent Laid-Open No. 164377/1992; applied for by Tadahiro Ohmi.)

The other alternative technology forms an oxide passivation film which has a Cr/Fe ratio (atom ratio: same as in hereinafter) of 1 or more at the surface thereof, and also enables to form a passivation film having a layered structure consisting only of chromium oxide at the surface thereof. That type of passivation film gives less gas emission and has excellent corrosion resistance.

However, the technology has a limitation in terms of the thickness of the formed film, which is approx. 20Å (angstrom) at the maximum. Recent demand to increase the corrosion resistance requests the formation of a passivation film that provides a thicker layer consisting only of chromium oxide and has improved corrosion resistance.

In this respect, an object of the present invention is to provide a stainless steel having corrosion resistance which is superior to the one prepared through prior art.

Another object of the present invention is to provide a method of forming an oxide passivation film having a layer consisting of a chromium oxide, which layer enables the formation of a passivation film consisting only of chromium oxide and having a thickness of 20Å (angstrom) or more at the surface thereof.

DISCLOSURE OF THE INVENTION

The present invention is characterized in that a stainless steel having excellent corrosion resistance has an oxide passivation film consisting mainly of chromium oxide with a thickness of at least 20Å (angstrom) on the outermost surface thereof.

The present invention is also characterized in that the method of forming an oxide passivation film having a chromium oxide layer on the surface of the film comprises: forming a work strain layer consisting of fine crystals on the surface of a stainless steel base; baking the stainless steel base having the work strain layer in an inert gas atmosphere to remove moisture from the surface thereof; then thermally treating the stainless steel in an atmosphere of a gas mixture containing an inert gas and 500 ppb to 2% of $H_2O$ at a temperature of 450 to 600° C. to form the oxide passivation film.

The present invention is further characterized by that the method of forming an oxide passivation film having a chromium oxide layer on the surface of the film comprises: forming a work strain layer consisting of fine crystals on the surface of a stainless steel base; baking the stainless steel base having the work strain layer in an inert gas atmosphere to remove moisture from the surface thereof; then thermally treating the stainless steel in an atmosphere of gas mixture containing an inert gas and from 4 ppm to 1% of $O_2$ at a temperature of 450 to 600° C. to form the oxide passivation film.

Function

The present invention is described below in more detail referring to the embodiment examples.

A preferred stainless steel of the present invention is SUS 316L containing 0.030% or less of C, 0.70% or less of Si, 0.80% or less of Mn, 0.030% or less of P, 0.0020% or less of S, 12.0 to 17.0% of Ni, 16.0 to 24.0% of Cr, 0.05 to 3.5% of Mo, 0.020% or less of Al, and 0.0020% or less of 0 by weight.

According to a method of the present invention, a work strain layer consisting of fine crystals is firstly formed on the surface of a stainless steel. That type of work strain layer of fine crystals is formed by electrochemical buffing (ECB), for example.

An example of the electrochemical buffing used in present invention is the one in which an anodic metal to be buffed is electrolytically eluted, and at the same time, the oxide passivation film formed on the surface of the metal is polished to mirror-finish surface using abrasives. This procedure may be performed by giving the abrasives a certain minimum speed to abrade the buffing surface, and at the same time, by inducing an anodic reaction of elution and oxidation on the buffing surface while applying an electrolytic current density of several ampere per square centimeter via a passivated electrolyte solution.

The method of the present invention is further described below referring to FIG. 8.

FIG. 8 illustrates an example of a tool used for the mirror-finishing process of the present invention. The reference number 1 denotes the tool which is attached to the drive shaft and is rotated by a driving means. The reference number 2 denotes the circular disk cathode made of copper formed at the bottom of the tool 1. The reference number 3 denotes the exposed face formed in a cross-like shape on the bottom face of the cathode 2. The reference number 4 denotes the discharge opening for the electrolyte solution 5, which is formed at the center of the cathode 2 as a through-hole. The reference number 6 denotes the abrasives attached to the whole area of the bottom surface of the cathode 2 excluding the exposed face 3 and of the discharge opening 4. The reference number 7 denotes a thin film such as paint which has an electrical insulation property. The insulating thin film prevents useless current leakage from the periphery of cathode 2 of tool 1. The electrolyte solution 5 is fed from an electrolyte supply unit via the drive shaft, and is supplied to the gap between the exposed face 3 and the metal being buffed (not shown) via the discharge opening 4, then it is discharged to the outside of the tool. The cathode side and anode side of DC voltage or a pulse voltage are connected to the cathode 2 of the tool 1 and the metal being buffed, respectively.

At the start of buffing, a voltage is introduced between the cathode 2 of the tool 1 and the metal being buffed while introducing the electrolyte solution 5 therebetween. The cathode 2 is rotated while being pressed to the metal for buffing. Thus, the anode elution of the metal for buffing is performed by electrolytic action. The convex portion of the oxide passivation film formed on the irregular surface of the metal for buffing is removed by the abrading action of the abrasives 6, and the convex portion of the metal for buffing is preferentially and selectively electrolytically eluted to make the surface mirror-finish.

For example, in the case that the interior surface of a SUS 316L having an original surface roughness, $R_{max}$, of 20 to 50 microns is buffed using SiC abrasives of from #120 to #1500, the buffing with a 20-% $NaNO_3$ aqueous solution as the electrolyte solution of passivation type while applying an electrolytic current density of 0 to 6 $A/cm^2$ gives a interior surface having a surface roughness, Rmax, of 0.1 micron or less.

The present invention includes the formation of a surface work strain layer using the electrochemical buffing or other means as an essential condition. Electrolytic polishing (EP) alone cannot form a layer consisting only of chromium oxide having a thickness of 20Å (angstrom) or more because of the absence of a work strain layer at the surface thereof.

The reason why electrolytic polishing alone cannot form a thick layer of chromium oxide is not clear, but the mechanism is presumed to be the following. Different from electrolytic polishing, electrochemical buffing grinds the surface mechanically as well. The mechanical grinding results in machining, plastic deformation, melting and chemical change. As a result, a so-called "Beilby layer" is formed, or a chemically active workstrain layer consisting of very fine crystals at the surface. At the same time, a plastic deformation layer is formed toward the inside of the structure. The presence of the Beilby layer presumably contributes to the formation of the layer consisting only of chromium oxide. That is, the diffusion of chromium along the boundaries of very fine grains is enhanced, and in a weakly oxidizing atmosphere, $Cr_2O_3$ is formed on the surface.

A preferred surface roughness resulting from the electrochemical buffing is 5 $\mu$m or less from the standpoint for forming a further dense passivation film, and most preferably 0.5 $\mu$m or less.

According to the present invention, moisture is removed from the surface of the stainless steel by baking it in an inert gas atmosphere after completing the electrochemical buffing. The temperature and period of baking are not specifically limited provided that the temperature is at a level enabling the moisture removal. For example, the baking may be conducted at a temperature ranging from 150 to 200° C., or at a higher range of from 400 to 500° C. The baking is preferably carried out in an inert gas atmosphere (Ar gas, $N_2$ gas, etc.) containing up to several ppm of $H_2O$ (most preferably up to several ppb).

Then, the heat treatment is conducted at a temperature level ranging from 450 to 600° C. in a weakly oxidizing mixed gas atmosphere.

The inert gas may be argon gas or nitrogen gas.

The content of $H_2O$ gas is in a range of from 500 ppb to 2%. If the content of $H_2O$ gas is less than 500 ppb, then the layer consisting only of chromium oxide can not be formed on the surface, and the surface becomes a mixed texture of iron oxide and chromium oxide.

If the $H_2O$ content exceeds 2%, then a passivation film consisting mainly of iron oxide is formed and the film becomes porous, which results in poor corrosion resistance.

It is preferable that the mixed gas of an inert gas and from 500 ppb to 2% of $H_2O$ further contains 10% or less of hydrogen. Hydrogen gas becomes H* radical by the catalytic action of the stainless steel surface, and the radical contributes to the reduction of iron oxide. In other words, on a mirror-finished surface treated with electrochemical buffing, the Ni in the stainless steel plays the role of catalyst, and the hydrogen nearly perfectly becomes radical at a temperature range of from 450 to 600° C., and the hydrogen radical reduces the iron oxide. Thus, the layer consisting only of chromium oxide should be more likely formed. However, when the content of hydrogen gas exceeds 10%, the density of the passivation film is lost. So the hydrogen gas content is preferably at 10% or less. If the hydrogen gas content is less than 1 ppm, the reduction of iron oxide may not proceed to a sufficient extent, so a preferable lower limit of hydrogen content is 0.1 ppm.

A common method to prepare a gaseous mixture of an inert gas and 500 ppb to 2% of $H_2O$ is to mix the inert gas with 500 ppb to 2% $H_2O$ in advance and then to supply the mixed gas to the stainless steel surface for forming passivation film. Alternatively, a gaseous mixture of an inert gas, 250 ppb to 1% of oxygen gas, and 500 ppb to 2% of hydrogen gas may be supplied to the stainless steel surface. In the latter case, the Ni in the stainless steel acts as the catalyst to generate hydrogen radical, and the radical reacts with oxygen to yield $H_2O$ gas to form a designed weakly oxidizing atmosphere.

The temperature of the heat treatment is in a range of from 450 to 600° C. If the temperature is below 450° C., prolonged heat treatment can not increase the thickness of the film consisting only of chromium oxide to 20 angstroms or more. If the temperature exceeds 600° C., a layer containing segregated iron oxide is formed on the surface, and the total texture of the passivation film becomes non-uniform, which results in the formation of a passivation film with poor corrosion resistance. It is presumed that the reason for the poor characteristic is that, at above 600° C., chromium carbide ($Cr_{23}C_6$, etc.) deposits on the base material, and the deposit consumes the whole amount of Cr to induce a segregation in the texture of the passivation film.

Although the period for the heat treatment depends on the temperature, it is preferred that it is 0.5 hrs or more. Even when the heat treatment is conducted for a period of 5 hrs, the thickness of the chromium oxide layer does not increase anymore. Consequently, from an economic point of view, it is preferred that the upper limit of the heat treatment period be set at 5 hrs.

According to the invention, it is preferable to use a stainless steel having a crystal grain size of 6 or more, and most preferably to use a stainless steel having a crystal grain size of 8 or more. The stainless steel having a crystal grain size of that range quite easily allows for the formation of a passivation film having a layer consisting only of chromium oxide at the surface thereof. The reason for such an easy formation is not clear, but it is presumed that the mechanism is that a stainless steel having a crystal grain size in that range enhances the surface diffusion of chromium atoms via the grain boundaries and that a smaller crystal grain size in the base material results in a smaller crystal grain size in the Beilby layer which was described before or in the plastic deformation layer and that Cr becomes so that it easily diffuses toward the surface through these grain boundaries.

According to the invention, the heat treatment is preferably conducted in an atmosphere of a gaseous mixture of an inert gas and from 4 ppm to 1% of oxygen gas.

If the oxygen content is less than 4 ppm, a passivation film having the chromium oxide layer with a thickness of 20 angstrom or more cannot be formed at the surface thereof. If the oxygen content exceeds 1%, the surface becomes a layer consisting of a mixture of iron oxide and chromium oxide.

The range of the heat treatment temperature is from 450 to 600° C.

The preferred period of heat treatment is 1 hr or more, though it depends on the temperature applied.

Also in the invention, it is preferred to use a stainless steel base having a crystal grain size of 6 or more, most preferably a crystal grain size number of 8 or more.

BRIEF DESCRIPTION OF THE DRAWINGS

FIG. 1(*b*) is an XPS analysis chart of an oxide passivation film of Comparative Embodiment 1 having a $H_2O$ content of 1 ppm. FIG. 2(*b*) is an XPS analysis chart of an oxide passivation film of Comparative Example 1 having a $H_2O$ content of 1%. FIG. 6(*b*) is an XPS analysis chart of an oxide passivation film formed in Comparative Example 1.

BEST MODE FOR CARRYING OUT THE INVENTION

The present invention is described in more detail in the following referring to an embodiment.

Embodiment 1

A stainless steel of SUS 316L having a crystal grain size of 6 and contains 25 ppm of oxygen was treated by the electrochemical buffing following the procedure described in the section on the function of the present invention. The obtained surface roughness was about 5 $\mu$m.

Then, the stainless steel was charged into a furnace to conduct the baking at 150° C. for 2 hrs to remove the surface moisture while introducing a stream of argon gas containing impurities of up to several ppb.

After completing the baking treatment, the heat treatment was conducted at 500° C. for 1 hr in a mixed gas atmosphere in which the hydrogen gas was diluted with argon gas to give a hydrogen concentration of 10%, and further $H_2O$ gas was added at several concentration levels, separately.

Figure 1A:
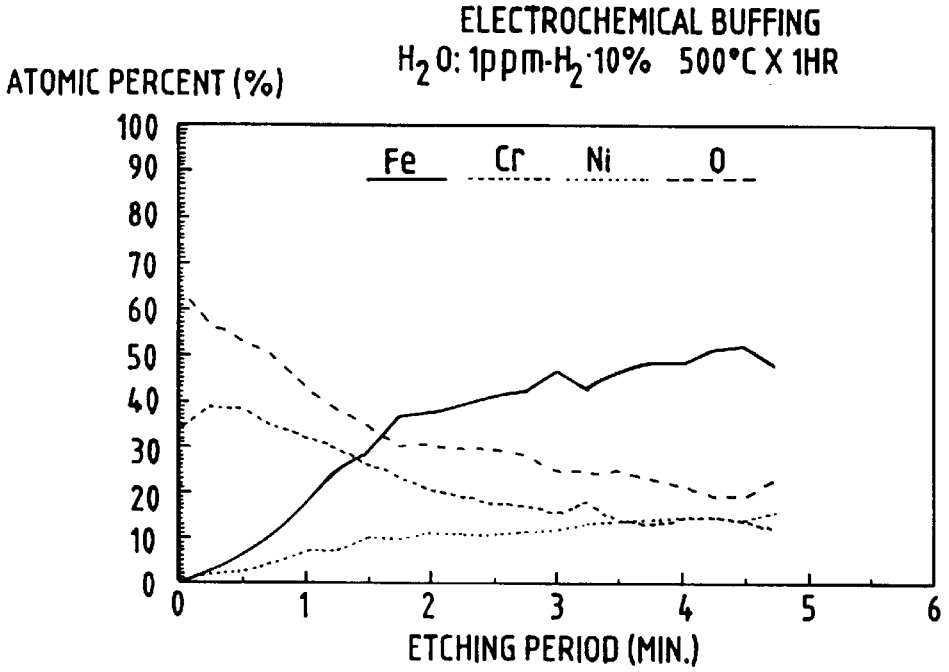
FIG. 1(*a*) is an XPS analysis chart of an oxide passivation film of Embodiment 1 having a $H_2O$ content of 1 ppm.
Figure 1B:
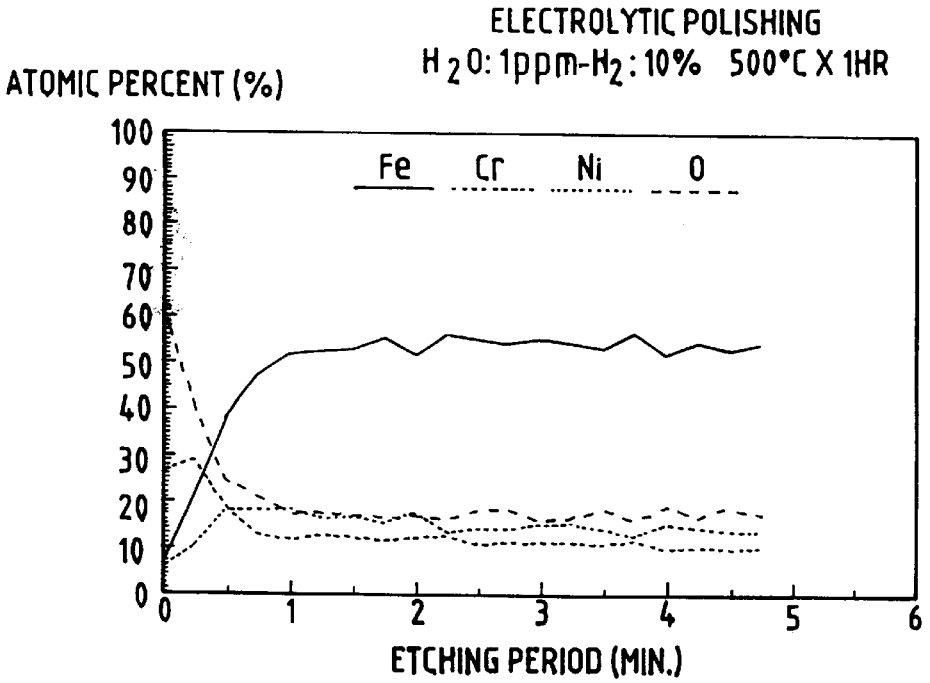
Figure 2A:
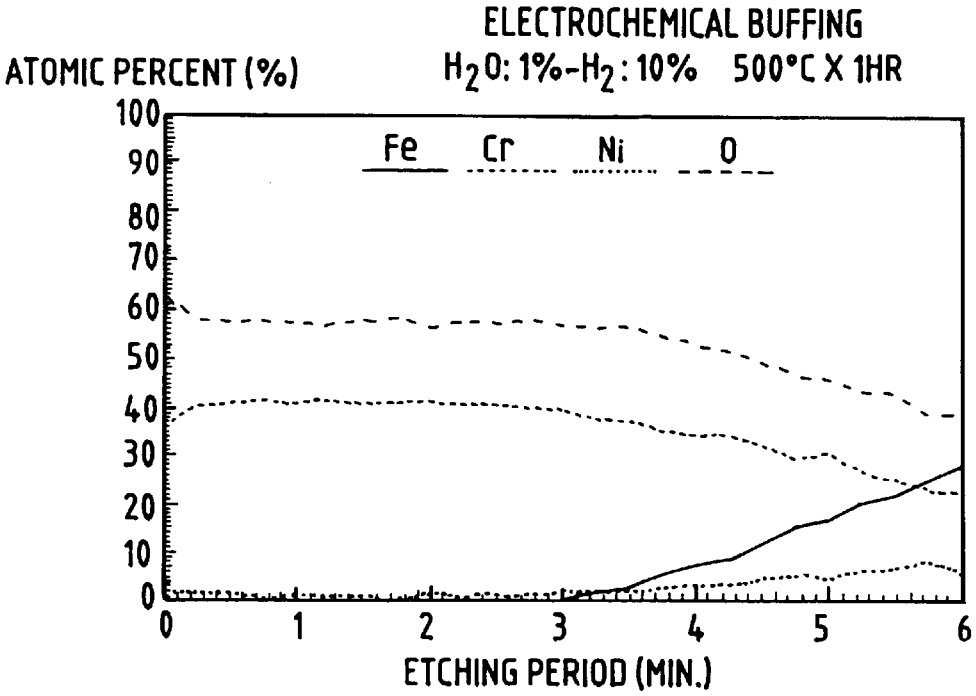
FIG. 2(*a*) is an XPS analysis chart of an oxide passivation film of Embodiment 1 having a $H_2O$ content of 1%.
Figure 2B:
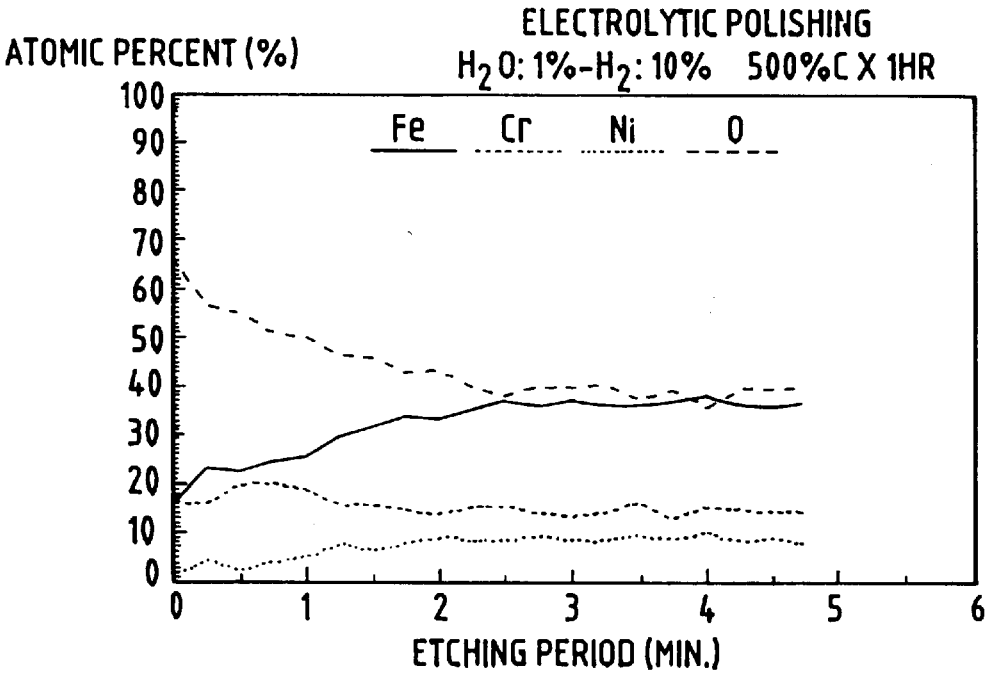

FIG. 1(*a*) and FIG. 2(*a*) give the XPS analysis charts of the passivation films in the case of a $H_2O$ content of 1 ppm and 1% $H_2O$, respectively. The etching speed was 70 Å/min. in both cases.

As seen in FIG. 1(*a*) and FIG. 2(*a*), the passivation films formed in this embodiment contain no iron oxide and contain mainly chromium oxide on the surface.

Figure 3:
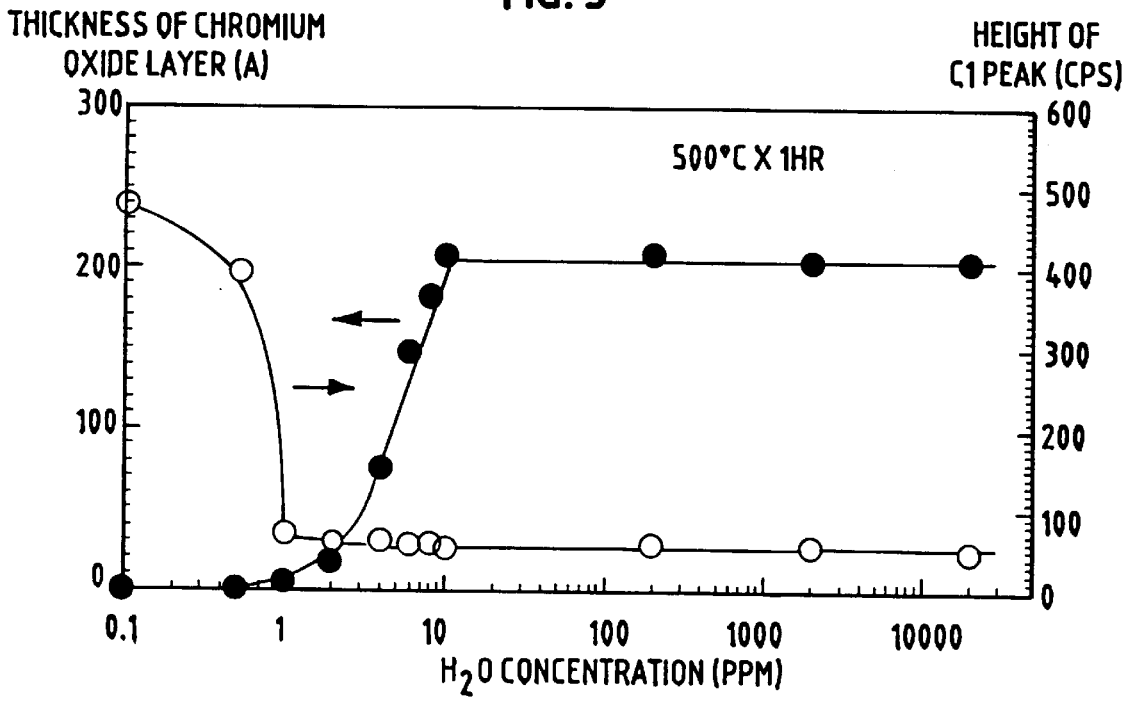
FIG. 3 is a graph showing the relation between the $H_2$ concentration, the thickness of the chromium oxide layer formed and the corrosion resistance thereof.

FIG. 3 shows the relation between the $H_2O$ concentration, the thickness of the chromium oxide layer, and the corrosion resistance thereof. As shown in FIG. 3, at up to 10 ppm of $H_2O$ concentration, the increase of $H_2O$ concentration increases the thickness of the chromium oxide layer, (which is shown by closed circles in FIG. 3), and the thickness nearly reaches a maximum at 10 ppm or more. Particularly, at a $H_2O$ concentration of above 2 ppm, the formation of a chromium oxide layer having 20 angstrom or more is formed; such a thick layer was not formed in the prior art.

On the other hand, the increase in the thickness of chromium oxide layer, (which is shown by an open circle in FIG. 3), improves the corrosion resistance.

The corrosion resistance test was carried out by introducing hydrogen chloride gas containing 1000 ppm of $H_2O$ gas into the container along with the sample, and by allowing them to stand at 50° C. for 14 days. The evaluation of corrosion resistance was made by analyzing the sample surface using ESC to determine the Cl peak. Since a part of the surface which was corroded by hydrogen chloride gas is converted to a chloride, a large amount of chlorine is detected. The result suggests that the formation of a dense chromium oxide layer on the surface induces a sudden increase in the corrosion resistance.

Embodiment 1 selected 500° C. as the temperature of the heat treatment. When the heat treatment was carried out at a temperature of higher than 500° C., the formation of a chromium oxide layer having a thickness of 20 angstrom or more was performed even when the concentration of $H_2O$ was selected to be 500 ppb.

Comparative Example 1

In Comparative Example 1, the same procedure as that of Embodiment 1 was followed except that the electrolytic polishing was used instead of the electrochemical buffing.

FIG. 1(*b*) and FIG. 2(*b*) show the XPS analysis charts of the passivation film formed under the condition given above. These figures clearly show that the electrolytic polishing gave a surface layer containing iron oxide, though the layer was rich in chromium oxide.

Embodiment 2

In Embodiment 2, the effect of the length of heat treatment period was studied.

The heat treatment was carried out at 500° C. in a mixed gas atmosphere containing argon gas as the base component and containing 10% of hydrogen and 8 ppm of $H_2O$ gas for a varied period, separately. The other conditions were the same as in Embodiment 1.

Figure 4:
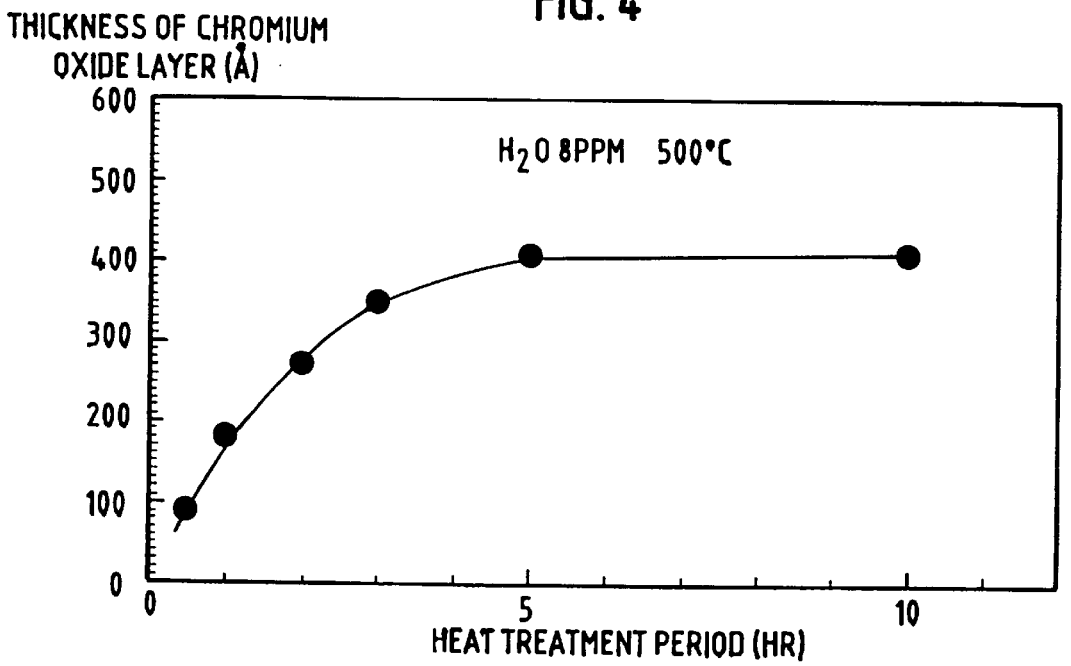
FIG. 4 is a graph showing the relation between the heat treatment period, the thickness of chromium oxide layer formed and the corrosion resistance thereof.

FIG. 4 shows the relation between the heat treatment period and the thickness of chromium oxide layer. As seen in FIG. 4, a heat treatment of as short as 0.5 hrs resulted the formation of a 100% chromium oxide layer of a thickness of nearly 100 angstrom at the surface of the base material. Up to 5 hrs of heat treatment, the layer thickness increases with the increase in heat treatment period. However, heat treatment of longer than 5 hrs gave very little increase in thickness.

Embodiment 3

In Embodiment 3, the effect of the temperature of the heat treatment was studied.

The heat treatment was carried out in a mixed gas atmosphere containing argon gas as the base component and containing 10% of hydrogen and 8 ppm of $H_2O$ gas for 1 hr at varied temperature levels, separately. The other conditions were the same as in Embodiment 1.

Figure 5:
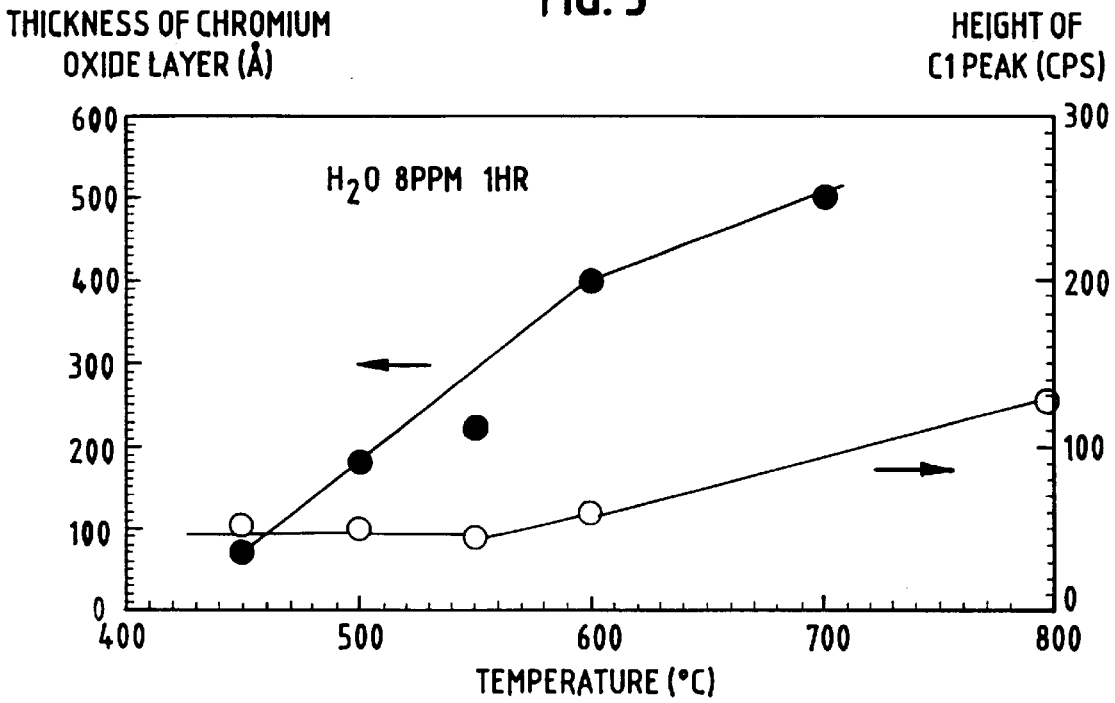
FIG. 5 is a graph showing the relation between the temperature of the heat treatment and the thickness of chromium oxide formed.

FIG. 5 shows the relation between the heat treatment temperature, the thickness of chromium oxide layer and the corrosion resistance thereof. As seen in FIG. 5, heat treatment at a temperature of 450° C. or above resulted in the formation of a 100% chromium oxide layer to a thickness of near to 100 Å at the surface of base material. The layer thickness increases with the increase in the heat treatment temperature.

However, heat treatment at higher than 600° C. gave an increase in thickness of the chromium oxide layer, but also started the degradation of corrosion resistance. The trend is shown in FIG. 5 by the increase in the surface C1 peak after the standing test in a HCl gas atmosphere.

Embodiment 4

Embodiments 1 through 3 used a mixed gas prepared by diluting hydrogen gas with argon gas to a hydrogen concentration of 10% and further by adding $H_2O$ gas in advance to form the passivation film. In Embodiment 4, however, oxygen was added instead of $H_2O$ gas to yield $H_2O$ gas on the surface of the stainless steel.

The used gas had the composition of:

Argon as the base component,

Hydrogen gas at 10%,

Oxygen gas at 1000 ppm.

The heat treatment was conducted at a temperature of 500° C. for 1 hr.

Figure 6A:
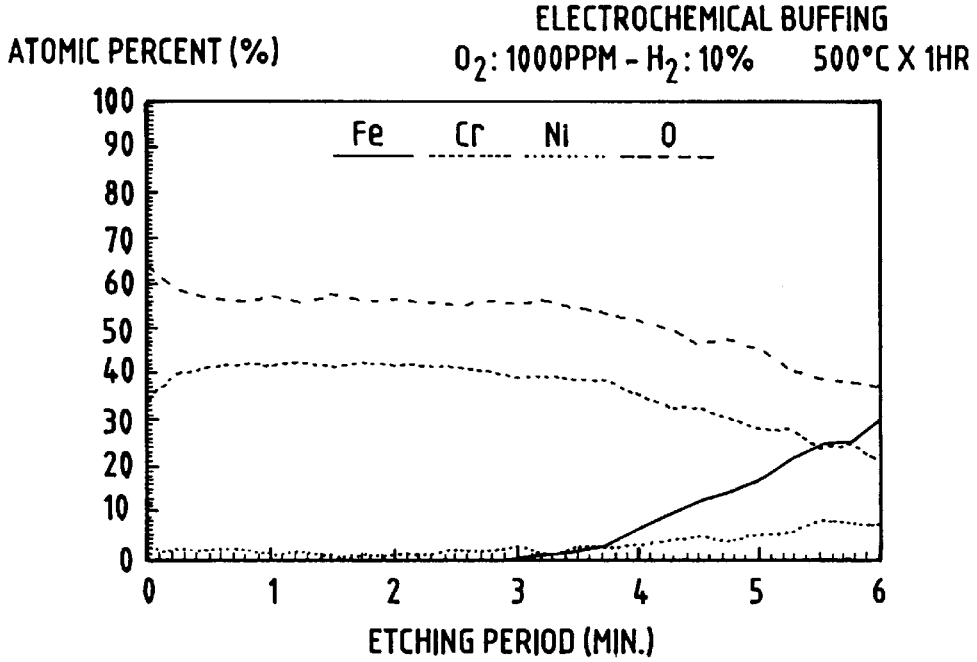
FIG. 6(*a*) is an XPS analysis chart of an oxide passivation film formed in Embodiment 6.
Figure 6B:
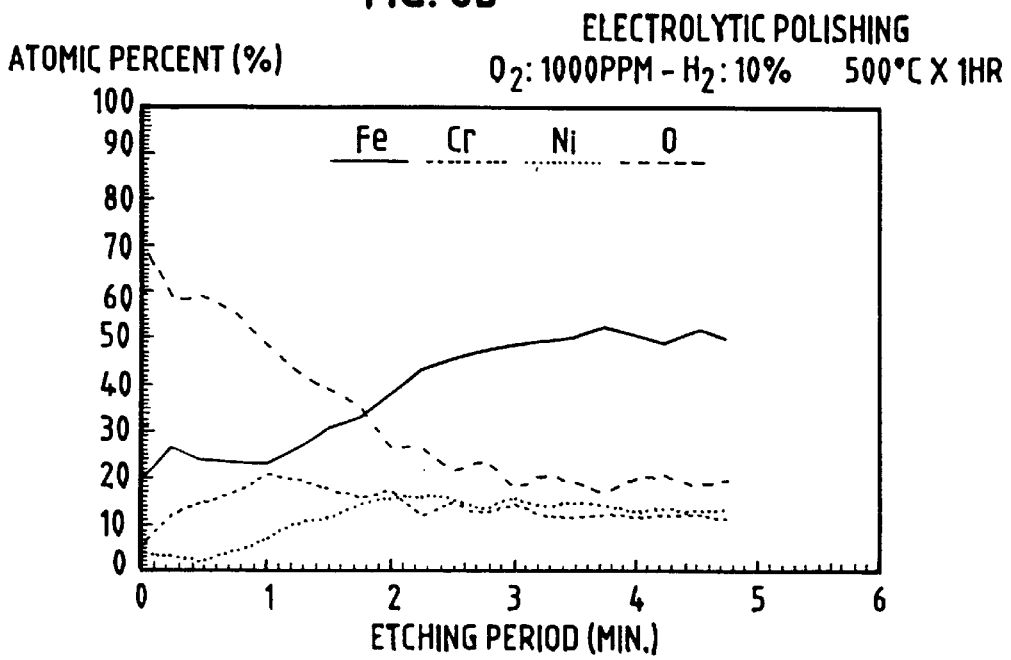

FIG. 6(*a*) shows the XPS chart of passivation film formed under the condition described above. The figure clarifies that this embodiment also gave a similar result as that of Embodiment 1.

FIG. 6(*b*) shows the XPS analysis chart for the case in which electrolytic polishing was applied instead of electrochemical buffing. In this case, the surface of passivation film contains iron oxide.

Embodiment 5

A stainless steel of SUS 316L having a crystal grain size of 6 and contains 25 ppm of oxygen was treated by the electrochemical buffing following the procedure described in the section of function of the present invention, and prepared the surface thereof to about 5 $\mu$m of surface roughness.

Then, the stainless steel was charged into a furnace to conduct the baking at 150° C. for 2 hrs to remove the surface moisture while introducing a stream of argon gas containing impurities at up to several ppb.

After completing the baking treatment, the heat treatment was given in an mixed gas atmosphere consisting of argon gas and various concentrations of oxygen gas, separately.

The temperature and period of heat treatment were selected at 500° C. and 1 hr.

Figure 7:
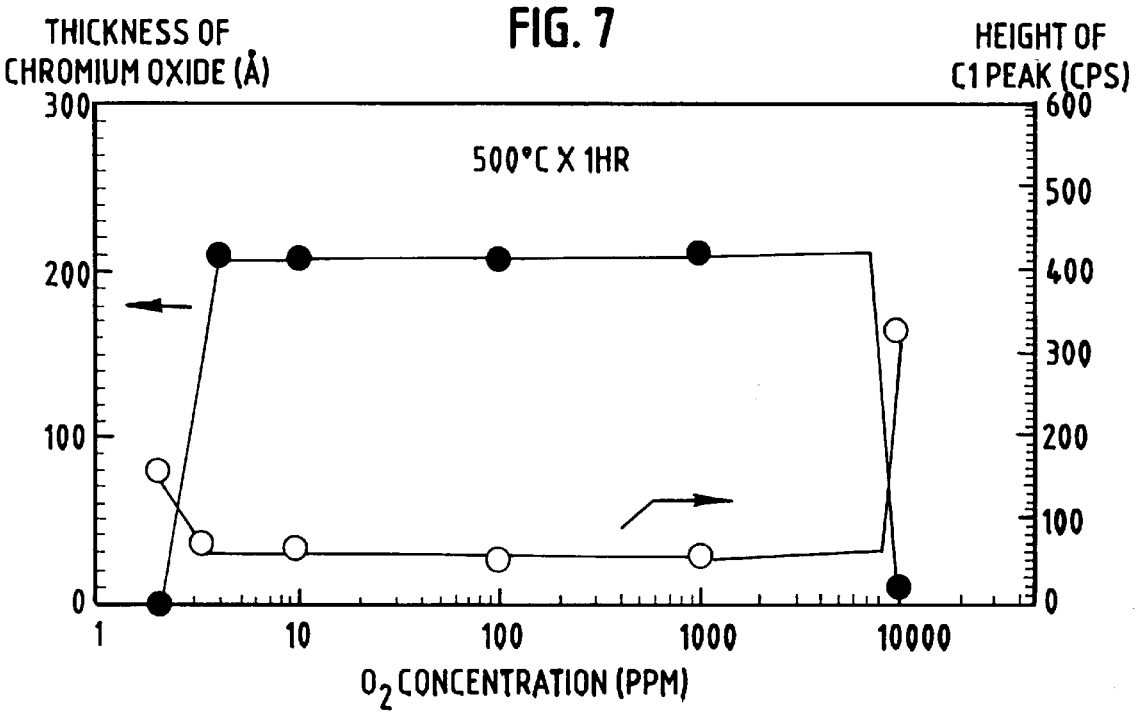
FIG. 7 is a graph showing the relation between the $O_2$ concentration, the thickness of chromium oxide layer formed, and the corrosion resistance thereof.
Figure 8A:
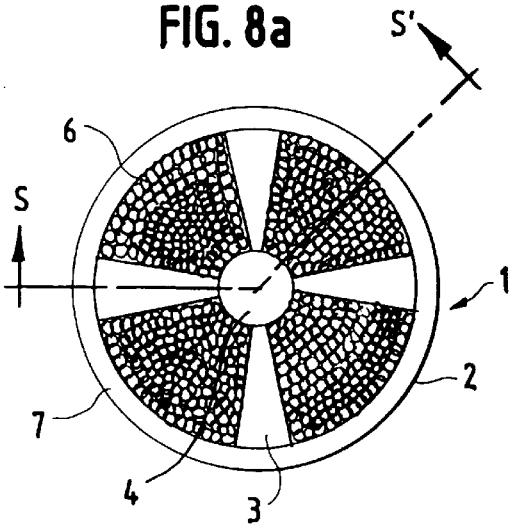
FIG. 8 shows the procedure of electrochemical buffing.
Figure 8B:
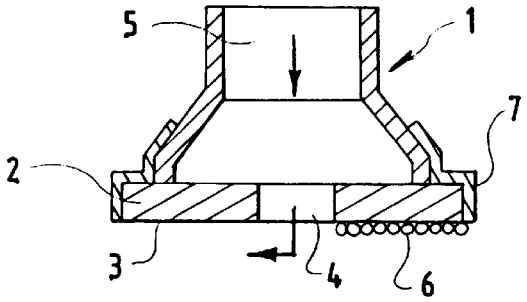
Figure 9:
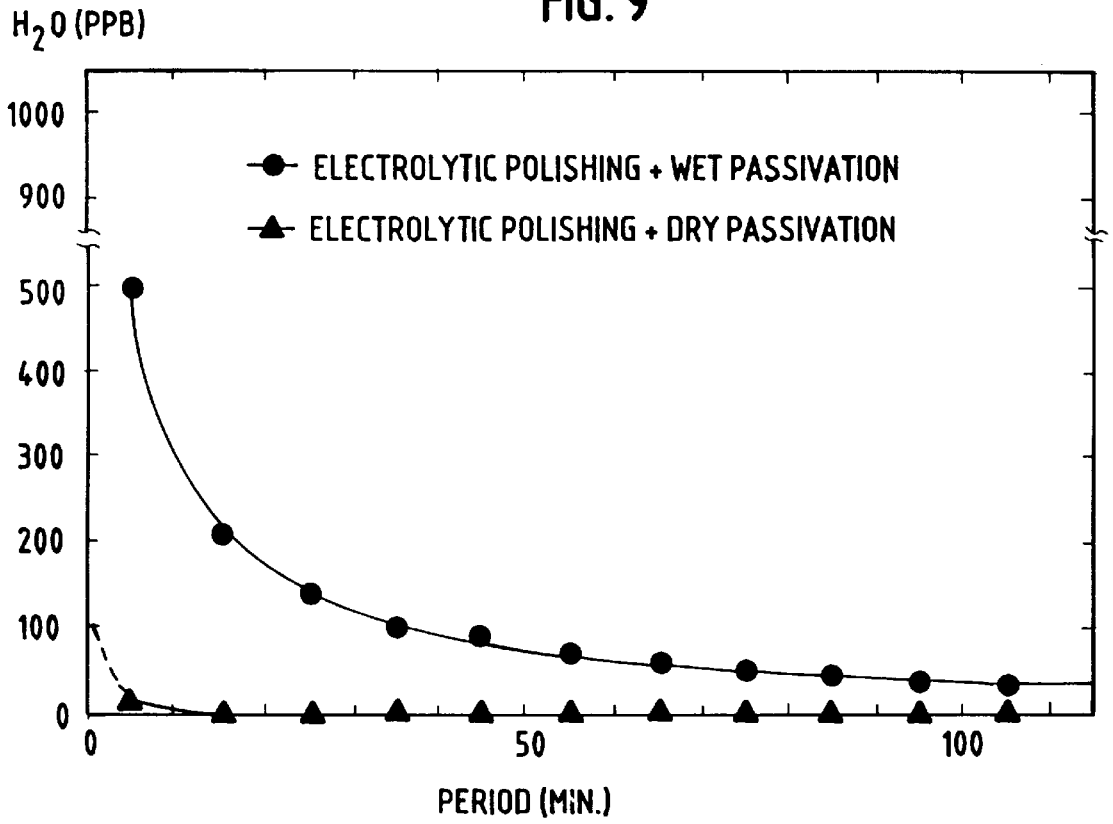
FIG. 9 is a graph showing the quantity of moisture emitted from the surface of a stainless steel.
Figure 10:
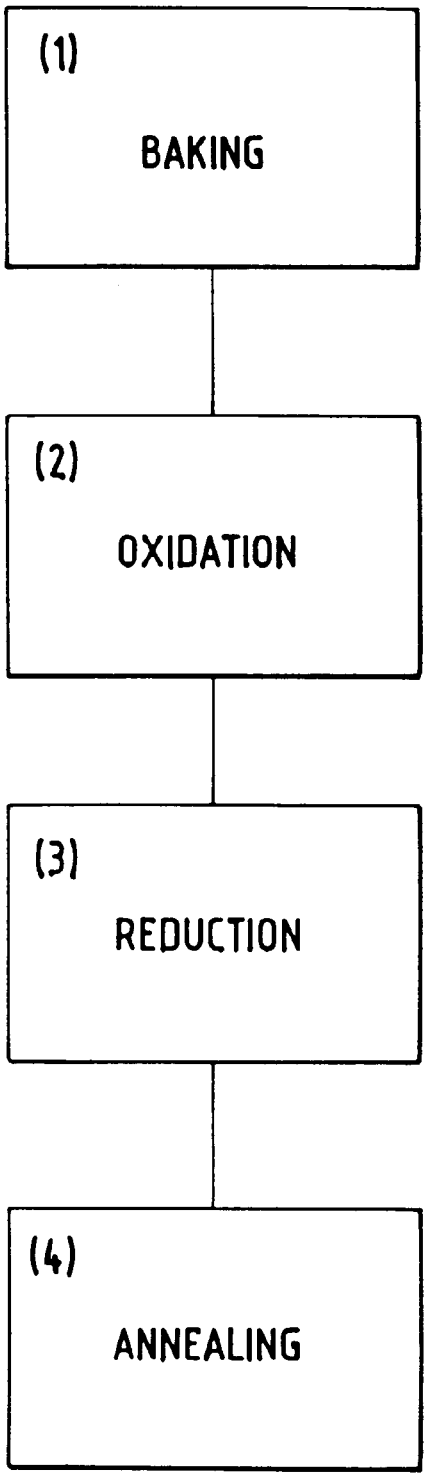
FIG. 10 illustrates the block flow diagram of the dry process.

FIG. 6(*a*) shows the XPS analysis chart of the passivation film formed under the conditions described above. The etching speed selected was 70 Å/min. As seen in FIG. 7, with a oxygen content of from 4 ppm to 1%, the layer consisting only of chromium oxide having a thickness of as large as 400 Å was formed, and the corrosion resistance was excellent. If the oxygen content was less than 4 ppm or more than 1%, then the thickness of the layer consisting only of chromium oxide showed a sudden decrease, and the corrosion resistance was also degraded. The degradation trend is shown in the increase of surface concentration of hydrogen chloride following standing test in a HCl gas atmosphere containing moisture.

Embodiment 6

In Embodiment 6, the effect of stainless steel crystal grain size was studied.

The selected crystal grain sizes were 5, 6, 7, and 8. A stainless steel of each grain size was subjected to heat treatment in a mixed gas of argon gas as the main component and 10% of hydrogen gas and 8 ppm of $H_2O$ gas. The temperature of heat treatment was 500° C., and the period of heat treatment was 1 hr.

Study of the XPS analysis chart for each of the tested passivation films revealed that the material of grain size 6 gave a thicker layer consisting of 100% chromium oxide than that of grain size 5, and that the material of grain size 7 gave a thicker layer consisting of 100% chromium oxide than that of grain size 6, and that the material of grain size 8 gave a thicker layer consisting of a 100% chromium oxide layer than that of grain size 7. Conclusively, the material having a smaller grain size formed a thicker layer of 100% chromium oxide.

As for the corrosion resistance, it was confirmed that material having a smaller grain size has superior corrosion resistance.

INDUSTRIAL APPLICABILITY

According to the invention, an oxide passivation film having a layer consisting of 100% chromium oxide at a thickness of 2 nm or more on the surface thereof is easily and quickly formed on the surface of a stainless steel. Such a thick layer of chromium oxide was not obtained in the prior art.

I claim:

1. Stainless steel comprising an oxide passivation film having a chromium oxide layer substantially free of iron oxide on the surface of the film, said layer made by the method comprising the steps of:

(a) forming a work strain layer consisting of fine crystals on the surface of a stainless steel base;

(b) baking the stainless steel base having the work strain layer in an inert gas atmosphere to remove moisture from the surface thereof; and (c) exposing the baked stainless steel of step (b) to heated atmosphere of a gas mixture containing an inert gas, from 500 parts per billion to two percent of $H_2O$ gas, and from about four parts per million to about one percent of $O_2$ gas, the atmosphere having a temperature of about 450° C. to about 600° C. to form said film layer.

2. The stainless steel of claim 1, wherein the formation of the work strain layer is achieved by electrochemical buffing of the surface of the stainless steel base.

* * * * *